US008401197B2

(12) United States Patent
Lee et al.

(10) Patent No.: US 8,401,197 B2
(45) Date of Patent: Mar. 19, 2013

(54) AUDIO POWER MONITORING SYSTEM

(75) Inventors: Noel Lee, Las Vegas, NV (US); Demian Martin, San Leandro, CA (US)

(73) Assignee: Monster, LLC, Las Vegas, NV (US)

( * ) Notice: Subject to any disclaimer, the term of this patent is extended or adjusted under 35 U.S.C. 154(b) by 1451 days.

(21) Appl. No.: 10/655,498

(22) Filed: Sep. 3, 2003

(65) Prior Publication Data

US 2005/0047605 A1 Mar. 3, 2005

(51) Int. Cl.
*H04R 29/00* (2006.01)

(52) U.S. Cl. ..... 381/56; 381/58; 345/87; 345/88; 345/33; 345/39; 345/46; 700/942

(58) Field of Classification Search ..... 381/58, 381/119, 56–57, 104–109; 700/94; 345/87–88, 345/33, 39, 46

See application file for complete search history.

(56) References Cited

U.S. PATENT DOCUMENTS 4,346,374 A * 8/1982 Groff ..... 340/573.1
5,444,783 A * 8/1995 Na ..... 381/57
5,524,060 A * 6/1996 Silfvast et al. ..... 381/104
5,751,817 A * 5/1998 Brungart ..... 381/309
5,751,819 A * 5/1998 Dorrough ..... 381/56
5,784,096 A * 7/1998 Paist ..... 348/32
5,917,288 A * 6/1999 Feldman et al. ..... 315/169.3
6,347,998 B1 * 2/2002 Yoshitomi et al. ..... 463/42
6,831,657 B2 * 12/2004 Tsutsumi et al. ..... 345/589
6,879,864 B1 * 4/2005 Cleary, Jr. ..... 700/94
6,941,161 B1 * 9/2005 Bobisuthi et al. ..... 455/569.1
2002/0186849 A1 * 12/2002 Duffy ..... 381/58
2004/0028235 A1 * 2/2004 Pan ..... 381/56
2004/0160199 A1 * 8/2004 Morgan et al. ..... 315/312

* cited by examiner

*Primary Examiner* — Disler Paul
(74) *Attorney, Agent, or Firm* — LaRiviere, Grubman & Payne, LLP

(57) ABSTRACT

An audio power display provides a signal and an update rate. An audio power monitoring system comprises a digital display unit including at least one light-emitting display element and a rapid update rate. The digital display unit displays signal levels at the rapid update rate to emphasize the dynamic nature of music. In one embodiment, the display update rate is varied to increase proportionally to increases in signal level, and decrease proportionally to decreases in signal level to further represent the dynamic nature of music.

13 Claims, 5 Drawing Sheets

AUDIO POWER MONITORING SYSTEM

FIELD OF THE INVENTION

The present invention relates to an audio power monitoring system. More particularly, an audio power monitoring system comprising a digital display unit including at least one light-emitting display element having an rapid display update rate, which rapid display update rate more effectively represents the dynamic nature of music.

DESCRIPTION OF THE PRIOR ART

A digital display unit for an audio power unit allows a user to visually experience the dynamic nature of music and other audio information. For example, a user may desire to visually experience a sudden rise in the bass level or the treble level while watching a movie or listening to music. A sudden rise in bass level or treble level may cause a sudden change in power level. This rise in power level may be captured and displayed to a user in a visually suggestive form so that a user may visually experience these dynamically changing music notes or melodies. It is desirable to use a digital display for its increasing resolution and better correlation to power numbers compared to analog display meters.

Unfortunately, present digital display units present a user with a direct measurement of the average level, the peak level, or some combination of average and peak levels, using an display update rate that is slow to improve its readability and that is unrelated to the dynamic nature of the music. Further, with the increasing popularity and sophistication of home entertainment equipment, there is an increasing desire for high end audio equipment to maximize the user's experience while listening to music or sounds. As a result, there is a need for a method and an apparatus for which allows a user to visually experience the dynamic nature of music as well as to provide additional advantages over the present audio equipment.

BRIEF SUMMARY OF THE INVENTION

The present invention provides to an audio power monitoring system. More particularly, an audio power monitoring system comprising a digital display unit for displaying an audio signal, wherein the digital display unit includes at least one light-emitting display element having a rapid display update rate, which rapid display update rate more effectively represents the dynamic nature of music. The rapid display update rate comprises sampling at discrete signal sample points along an envelope of the audio signal and displaying at least one signal sample point on the digital display unit.

In another embodiment, the digital audio power monitoring system may further comprise a display update rate increasing proportionally to increases in signal level, and decreasing proportionally to decreases in said signal levels, to more effectively represent the dynamic nature of the music. As such, a digital display unit displays at least one signal level at a display update. In addition, said display update rate varies as a function of said at least one signal level. For example, if the audio signal level is increasing, the digital display unit increases the display update rate of the digital display unit proportionally to the rate of increase in signal power level so that a user may visually perceive the increasing signal power levels, but not at a display update rate that is unreadable. In another example, if the audio signal level is decreasing, the digital display unit decreases the display update rate of the display proportionally to the rate of decrease in signal power level so that a user may visually perceive the decreasing signal power levels.

In one embodiment, a digital display unit is adapted to display a signal power level of one or more audio power amplifier channels. Advantageously, the digital display unit may be controllable and programmable by a user. It is another feature that the digital display unit includes a light-emitting display element chosen preferably from a group consisting of a Light Emitting Diode (LED), a 7 segment LED, a Liquid Crystal Display (LCD), a Cathode Ray Tube (CRT), a Nixie Tube, and a laser diode. It is another feature that a light-emitting display element may have a color selected from a group consisting of green, blue, red and/or a combination thereof to digitally display the signal power level.

It is another feature of the audio power monitoring system that a signal level of an audio channel may be selected from a group consisting of: right, left, center, rear, average of right and left, an average of the highest power level of multiple channels, and an average of multiple channels wherein a digital display unit is adapted to display the signal level at a display update rate, wherein said display update rate varies as a function of one selected from the group consisting of said at least one signal level, constant, programmable, and user controllable. It is an additional feature of the present invention that the digital display unit may be adapted to display and hold the peak value of one or more channels. It is another additional feature of the present invention that the digital display unit is adapted to display the difference in power level between one or more power amplifier channels. It is a further feature of the present invention that the color of the digital display unit may be selectable and/or programmable by a user.

In another embodiment, the digital display unit containing multiple spaced-apart light emitting display elements that are selectable by a user, wherein each of the multiple spaced-apart light-emitting display elements is individually controllable to display any of the following power levels: a right channel power, a left channel power, a center channel power, a difference between right and left channel powers, an average of power levels between multiple power amplifier channels, and an average of highest power of multiple channels. It is another aspect of the present invention that the light-emitting display elements are oval shaped and each of the light-emitting display elements may have multiple sizes and shapes. It is another aspect of the present invention that the digital display unit displays the peak signal values in a visually appealing format. The display of peak signal values indicates the maximum instantaneous power level that may be transferred to a load, thereby displaying for a user the safety margin associated with an electronic component.

DESCRIPTION OF DRAWINGS

For a better understanding of the present invention, reference is made to the below-referenced accompanying drawings. Reference numbers refer to the same or equivalent parts of the present invention throughout the several figures of the drawings.

DETAILED DESCRIPTION OF THE INVENTION

Figure 1:
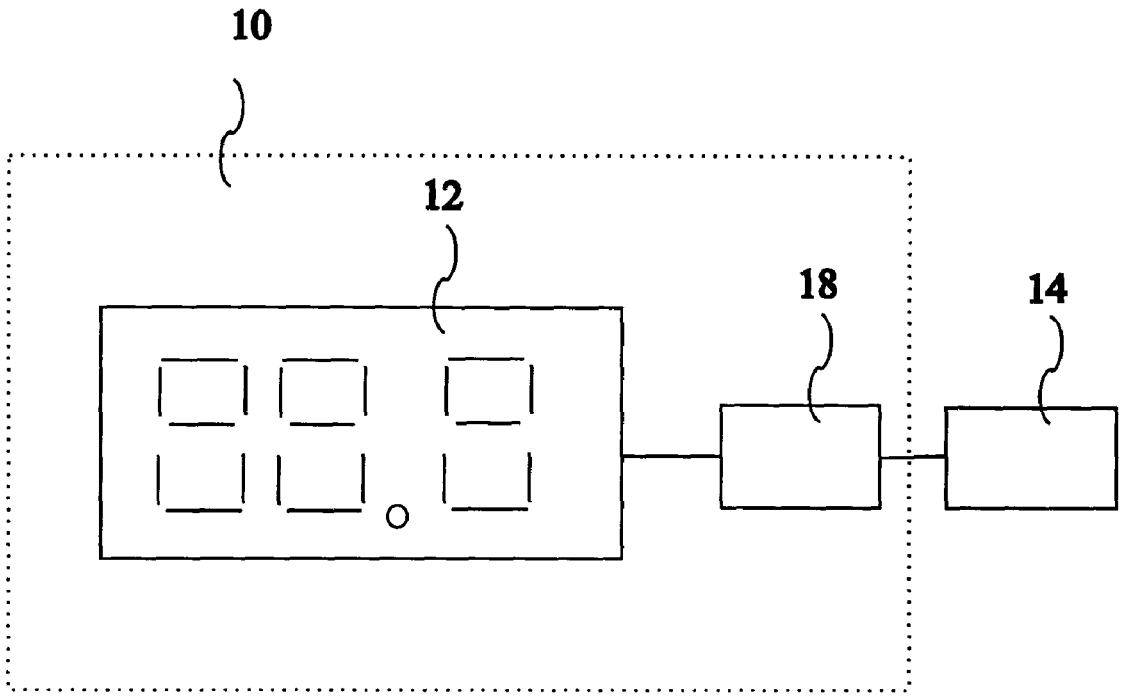
FIG. 1 is a block diagram of an audio power monitoring system in accordance with the first embodiment of the present invention.

Referring particularly to FIG. 1, a block diagram of an audio power monitoring system 10 of the present invention is shown. The audio power monitoring system 10 comprises a digital display unit 12 electrically connected to a signal conversion circuit 18. The signal conversion circuit 18 electrically connects to an electronic component 14. The electronic component 14 is preferably an audio power amplifier. In the alternative, the electronic component 14 may be any one of the following selected from the group consisting of a stereo receiver, a CD player, a DVD player, a plasma television, and a surround sound entertainment system.

Figure 2:
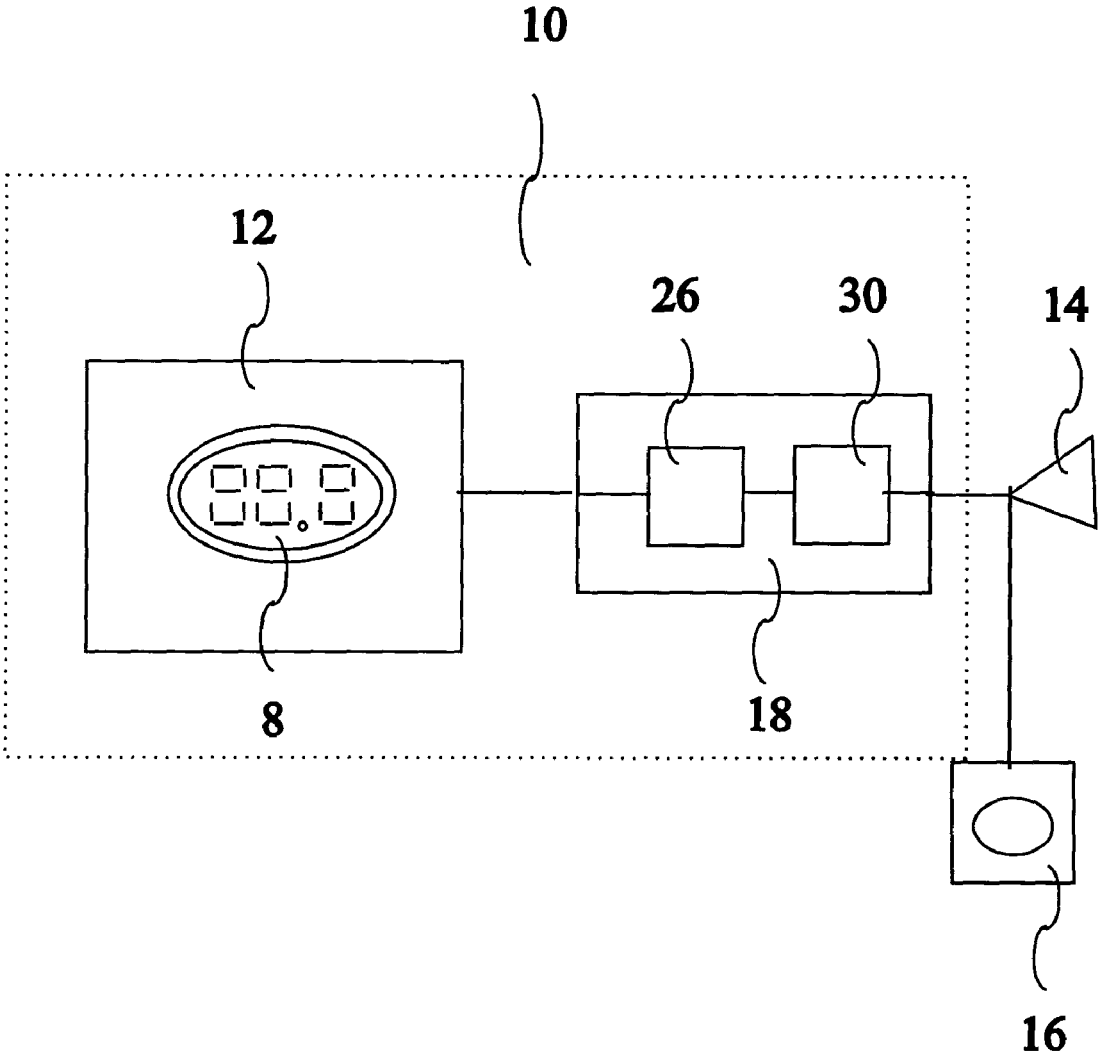
FIG. 2 is a block diagram of the digital display unit in connection with a control circuit and an audio power amplifier in accordance with the first embodiment of the present invention.

Referring particularly to FIG. 2, a block diagram of the digital display unit 12 in connection with an electronic component 14 and signal conversion circuit 18 is shown in accordance with the first embodiment of the present invention. The digital display unit 12 includes a light-emitting display element chosen preferably from a group consisting of a Light Emitting Diode (LED), a 7 segment LED, a Liquid Crystal Display (LCD), a Cathode Ray Tube (CRT), a Nixie Tube, and a laser diode. For the rest of the discussion, the light-emitting display element is a LED 8. The LED 8 may transmit a programmed or a user selectable color which is preferably blue, red or green or a combination of blue or green thereof.

In this embodiment, the electronic component 14 is an audio power amplifier. The electronic component 14 outputs an analog signal level, which results in an audio music level transmitted to an audio speaker unit 16 and to the signal conversion circuit 18. The signal conversion circuit 18 comprises an Analog-to-Digital (A/D) converter 30 and control circuit 26. In this embodiment, the analog signal level is input to an Analog-to-Digital (A/D) converter 30. The Analog-to-Digital converter 30 may be chosen from those available from commercial manufacturers such as Texas Instruments and Intel. The A/D converter 30 converts the analog signal level to an equivalent digital signal level. In the alternative, an analog signal level from the electronic component 14 may be measured using an analog voltage meter, an analog current meter, or an analog power meter.

In the preferred embodiment, the equivalent digital signal levels are input to a control circuit 26. The control circuit 26 is preferably an electronic programmable gate array (EPROM) or Application Specific Integrated Circuit (ASIC), which are well-known circuits to ones that are skilled in the art. The control circuit 26 function provides digital logic circuitry to store signal levels, to compute new signal levels, to modify and/or to combine prior and present measured signal levels. In the alternative, the control circuit 26 may be hardwired digital logic circuits such as latch circuits or digital counters to store signal levels.

Figure 2A:
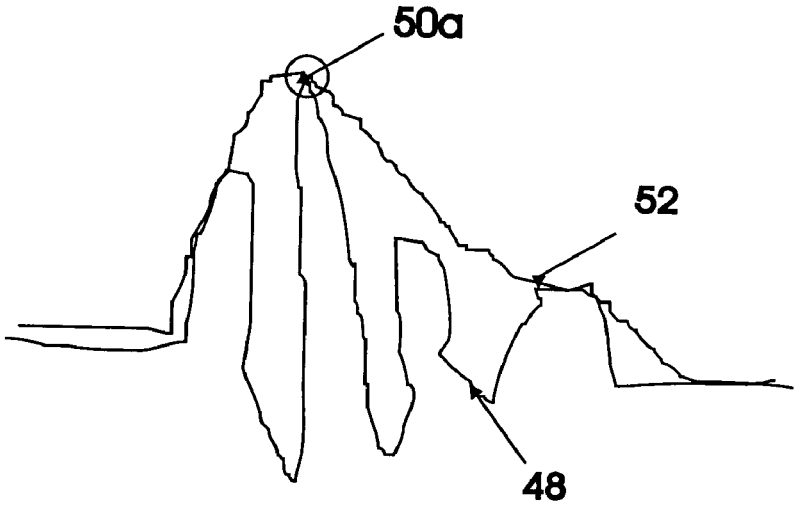
FIG. 2A is a graph depicting an audio signal in accordance with the first embodiment of the present invention.
Figure 2B:
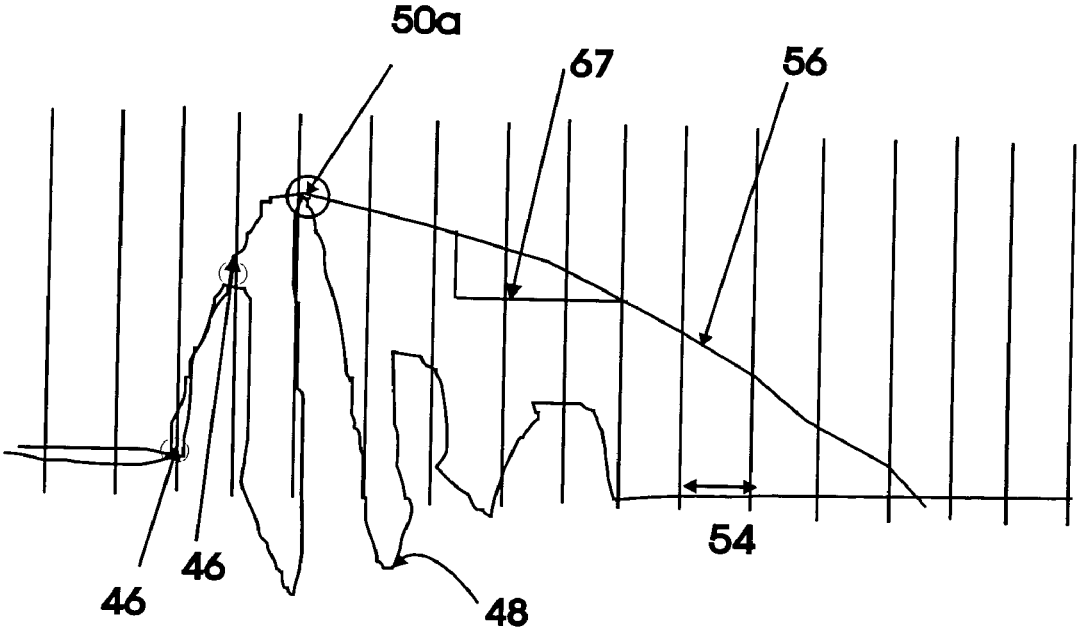
FIG. 2B is a graph depicting an envelope of a nominal peak value of an audio signal in accordance with the first embodiment of the present invention.

FIGS. 2A and 2B depict an audio signal as an envelope of the nominal instantaneous peak level. Specifically, FIG. 2A illustrates multiple instantaneous peak levels for an audio signal 48. FIG. 2A further depicts a first envelope 52 including a nominal peak level 50*a* for an audio signal 48. The nominal peak level 50*a* is the highest instantaneous peak level of an audio signal 48. FIG. 2B depicts a second envelope 56 for an audio signal 48 including a nominal peak level 50*a*, where the second envelope 56 has a limited rate of fall 67, i.e. slope, from the nominal peak level 50*a*. In this embodiment, the control circuit 26, which is electrically connected to the digital display unit 12, samples at discrete sample points 46 along the second envelope 56 of an audio signal 48 at a display update rate 54. The discrete sampled points 46 are transmitted to the digital display unit 12. In this example, a digital display unit will update its level reading at times corresponding to discrete sample points 46. In the alternative, the envelope 56 rate of fall 67, i.e. slope, may be programmed and/or selectable by a user. In another alternative, other peaks than a nominal peak level may have a rate of fall that has been pre-programmed, hardwired, and/or selectable by a user.

Additionally, FIG. 2A displays a nominal peak level 50*a* that may be tracked by a user. Further as shown in FIG. 2, the LED 8 displays the instantaneous peak signal level used to drive a load 16. The load 16 may be any audio component for example an audio speaker unit 16. As such, the LED 8 will display for a user information on the relative safety margin before the load 16 failure, allowing for example a user to properly select the correct power rating speaker units for a given audio power amplifier output power.

Figure 3:
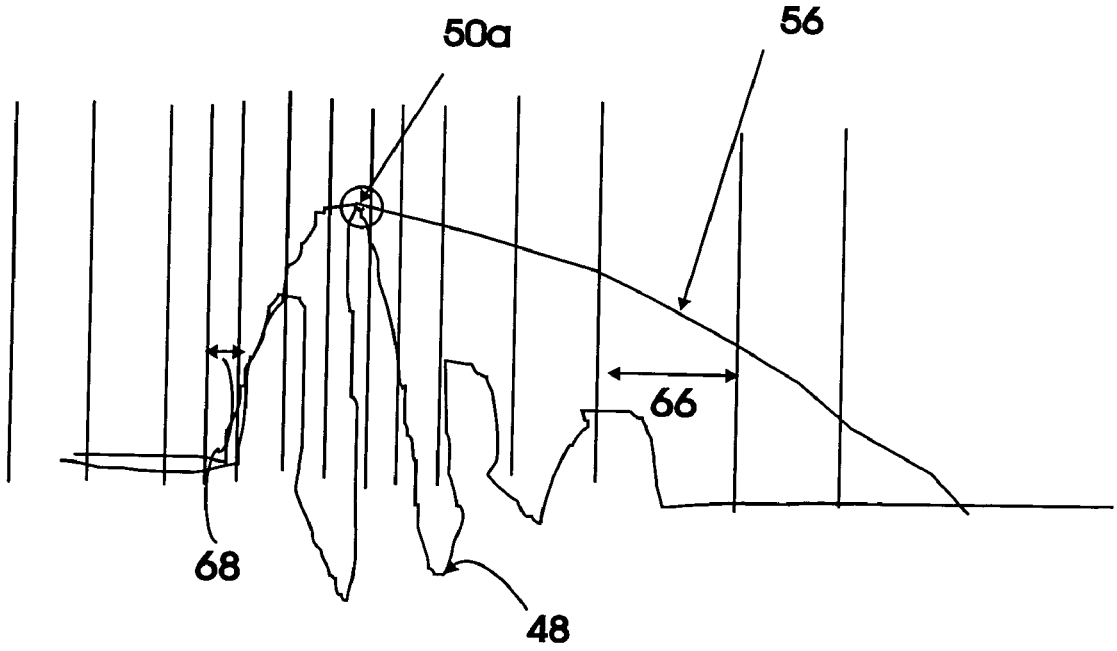
FIG. 3 is a graph depicting an envelope of a nominal peak value of an audio signal with display update rate proportional to increasing and proportional to decreasing audio signal levels in accordance with the second embodiment of the present invention.

FIG. 3 is a graph depicting an envelope of a nominal peak value of an audio signal with display update rate proportional to increasing and proportional to decreasing audio signal levels in accordance with the second embodiment of the present invention. In this embodiment, as shown in FIG. 2, the control circuit 26, which is electrically connected the digital display unit 12, is programmed to perform a comparison function between stored signal levels. The comparison function comprises computing and storing a difference between one or more stored signal levels. Depending on the difference, the control circuit 26 selects a display update rate and outputs a signal level at the selected display update rate. As such, the display update rate varies as a function of said at least one signal level. For example, when the difference between successively calculated signal level differences increases, the display update rate increases proportionally until a maximum display update rate is output to the digital display unit 12 including an LED 8. For the third embodiment, the display update rate 68 increases proportionally for increases in the audio signal 48 level to a nominal maximum value 50*a*, and the display update rate 66 decreases proportionally for decreases in the audio signal 48 level. Further, for this example, the display update rate is approximately 100 ms with the preferred range of 100 ms to 200 ms. On the other hand, if the voltage difference is decreasing, the display update rate will fall toward its minimum value. In another example, the audio system said display update rate is proportional to a difference between a present at least one signal level and a prior at least one signal level. In yet another example, the display update rate increases and decreases are adjustable by a user.

Figure 4:
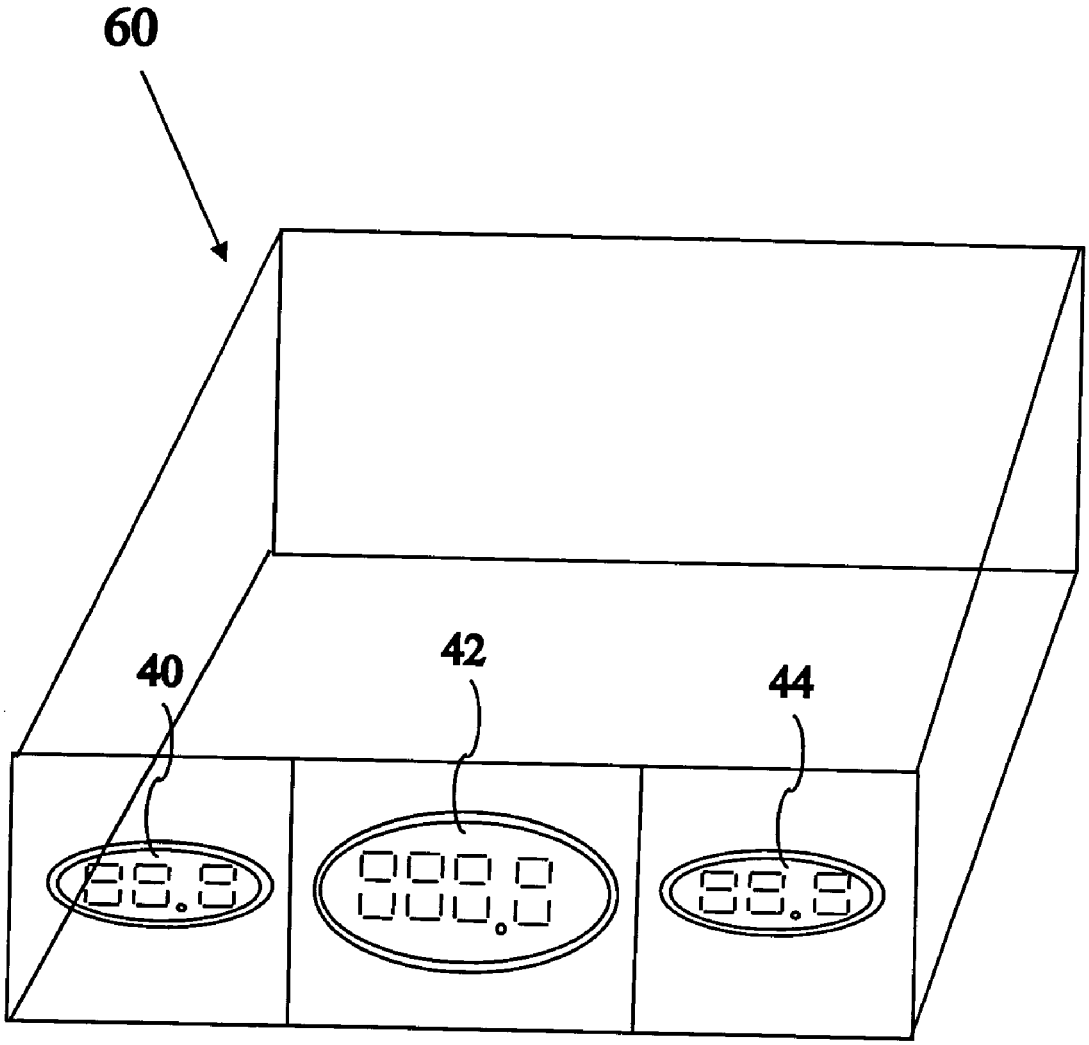
FIG. 4 is an audio power monitoring system including multiple spaced-apart light-emitting elements according to a third embodiment of the present invention.

FIG. 4 is an audio power monitoring system including multiple spaced-apart light-emitting elements according to a third embodiment of the present invention. In FIG. 4, the audio power monitoring system 60 comprises multiple spaced-apart light-emitting display elements 40, 42, 44. Each of the multiple spaced-apart light-emitting display elements 40, 42, 44 are preferably different sizes compared with adjacent light-emitting display elements. The multiple spaced-apart light-emitting display elements color are preferably selected from a group consisting of blue, green, red or a combination of blue, green, and/or red. Preferably, at least one of the multiple shaped-apart light-emitting display elements 40, 42, 44 is oval shaped. In the alternative, each light-emitting display element may define different colors, different shapes, and/or different styles from any other adjacent light-emitting display element. In the alternative, the light-emitting display elements may be positioned on opposite sides of a digital display unit 12 to create a more dynamic visual effect to a user. In another alternative, multiple spaced-apart light-emitting display elements may be positioned on any surface of a digital display unit.

In the third embodiment, each of the multiple light-emitting display elements 40, 42, 44 is independently controlled by a signal level. As such, each of the multiple light-emitting display elements 40, 42, 44 may have a display update rate that is different from any other light-emitting display element. Further, multiple light-emitting display elements 40, 42, 44 allow each audio channel power level or combination of audio channel power levels to be displayed to a user at the same moment in time. For example, in the preferred embodiment, one light-emitting display element of the multiple light-emitting display elements 40, 42, 44 may display one or more selected from the group consisting of a right channel power, a center channel power, a left channel power, an average of right and left channel powers, and an average of multiple channels power levels. Thus, dynamic changes in music power levels are reflected as changes in visual readout of the light-emitting display elements so that a user may more effectively experience music. Further, each of the multiple light-emitting display elements display update rate may be independently hardwired, programmed, or controlled by a user. It is a further feature that each light-emitting display element of said multiple oval shaped light-emitting display elements is independently user selectable to display at least one of said at least one signal level. Further, it is preferred that the multiple spaced-apart light-emitting display elements are multiple sizes of ovals.

Information as herein shown and described in detail is fully capable of attaining the above-described object of the invention, the present preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or a method step in the present disclosure is intended to be dedicated to the public regardless of whether the element, component, or a method step is explicitly recited in the claims. However, one skilled in the art should recognize that various changes and modifications in form and material details may be made without departing from the spirit and scope of the inventiveness as set forth in the appended claims. No claim herein is to be construed under the provisions of 35 U.S.C. §112, sixth paragraph, unless the element is expressly recited using the phrase "means for."

What is claimed:

1. An audio signal monitoring system for improving readability of a numerical signal level display, comprising:

a. a first unit for continuously computing the current signal level of an audio signal as the signal level changes; and b. a numerical display unit that displays the current signal level of the audio signal, the numerical display unit:

i. having a variable display update rate for continuously displaying the updated power level of the audio signal;

ii. wherein the signal level of the numerical display unit is updated at a first display update rate and a second display update rate;

iii. the first display update rate indicates signal increases;

iv. the second display update rate indicates signal decreases; and v. the first display update rate, showing signal increases, is greater than the second signal update rate, indicating signal decreases, such that as the signal level increases, the numerical signal level is updated at a higher rate than when the signal level decreases.

2. An audio power monitoring system in accordance with claim 1, wherein said first and second display update rates are functionally proportional to discrete audio signal sample points as the audio signal level changes.

3. An audio power monitoring system in accordance with claim 1, wherein said display update rate increases proportionately as the audio signal power level increases, and decreases proportionately as the audio signal power level decreases.

4. An audio power monitoring system in accordance with claim 1, wherein the digital display unit includes a numerical light-emitting display element.

5. An audio power monitoring system in accordance with claim 4, wherein the light-emitting display element is one selected from a group consisting of a Light Emitting Diode (LED), a 7 segment LED, a Liquid Crystal Display (LCD), a Cathode Ray Tube (CRT), a Nixie Tube, and a laser diode.

6. An audio power monitoring system in accordance with claim 4, wherein the color of light-emitting display element is selected from a group consisting of blue, green, red and a combination of blue and green.

7. An audio power monitoring system in accordance with claim 4, wherein the light-emitting display element is oval shaped.

8. An audio power monitoring system in accordance with claim 1, wherein said numerical display unit includes a plurality of light-emitting display elements wherein the display update rate of each of said plurality of light-emitting display elements is independently controlled.

9. An audio power monitoring system in accordance with claim 8, wherein said display update rate is proportional to a difference between the present audio signal level and a prior audio signal level.

10. An audio power monitoring system in accordance with claim 1, wherein the displayed audio signal level is selected from a group consisting of right, left, center, rear, average of right and left, and an average of multiple channels, and wherein said numerical display unit includes a plurality of separately user selectable oval shaped, light-emitting numerical display elements.

11. An audio power monitoring system in accordance with claim 1, wherein the displayed audio signal level is the maximum instantaneous power that may be transferred to a load.

12. An audio power monitoring system in accordance with claim 11, wherein the displayed audio signal level is a load and an envelope of a nominal peak level.

13. An audio power monitoring system in accordance with claim 1, wherein the update rate of the numerical display unit is adapted to instantaneously and continuously respond to a nominal peak audio signal level and to display an envelope of nominal peak audio signal level.

* * * * *